US008453552B2

(12) United States Patent
Farinella et al.

(10) Patent No.: US 8,453,552 B2
(45) Date of Patent: Jun. 4, 2013

(54) METHOD OF DESIGNING AN RPG SHIELD

(75) Inventors: Michael Farinella, Bolton, MA (US); William Lawson, South Hamilton, MA (US); Scott Quigley, Stoughton, MA (US); Robert Curran, Harrisville, RI (US)

(73) Assignee: QinetiQ North America, Inc., McLean, VA (US)

( * ) Notice: Subject to any disclaimer, the term of this patent is extended or adjusted under 35 U.S.C. 154(b) by 54 days.

(21) Appl. No.: 13/136,991

(22) Filed: Aug. 16, 2011

(65) Prior Publication Data

US 2012/0046916 A1 Feb. 23, 2012

Related U.S. Application Data

(63) Continuation-in-part of application No. 12/807,532, filed on Sep. 8, 2010, which is a continuation-in-part of application No. 12/386,114, filed on Apr. 14, 2009, now Pat. No. 8,011,285.

(60) Provisional application No. 61/124,428, filed on Apr. 16, 2008.

(51) Int. Cl.
*F41H 11/02* (2006.01)
*F41H 5/16* (2006.01)

(52) U.S. Cl.
USPC ..... 89/36.08; 89/901; 89/918; 89/939

(58) Field of Classification Search
USPC ..... 89/36.01–36.17; 109/49.5; 114/241; 296/187.07
See application file for complete search history.

(56) References Cited

U.S. PATENT DOCUMENTS

| | | | |
|---|---|---|---|
| 1,198,035 | A | 9/1916 | Huntington |
| 1,229,421 | A | 6/1917 | Downs |
| 1,235,076 | A | 7/1917 | Stanton |
| 1,274,624 | A | 8/1918 | Steinmetz |
| 1,367,249 | A | 2/1921 | Goodyear |
| 1,385,897 | A | 7/1921 | Tresidder |
| 1,552,269 | A | 9/1925 | Brocker |
| 2,238,779 | A | 4/1941 | Mosebach |

(Continued)

FOREIGN PATENT DOCUMENTS

| | | |
|---|---|---|
| DE | 691067 | 5/1940 |
| DE | 2206404 | 8/1973 |

(Continued)

OTHER PUBLICATIONS

Written Opinion of the International Searching Authority mailed Jan. 7, 2010 for International Application No. PCT/US2009/002363, 5 pages, unnumbered.

(Continued)

*Primary Examiner* — Bret Hayes
*Assistant Examiner* — Joshua Freeman
(74) *Attorney, Agent, or Firm* — Iandiorio Teska & Coleman LLP

(57) ABSTRACT

A method of designing an RPG. A computerized model is created of a shield mesh opening with lines of a net intersecting at nodes and with hard points positioned at least at select nodes. The effectiveness of the mesh opening at a plurality of obliquity angles is determined. In the model, a change is made to the size of the mesh opening and the effectiveness is determined again at a plurality of different obliquity angles. Iterations of this process allow an optimal mesh opening size to be determined for a threat such as an RPG.

16 Claims, 15 Drawing Sheets

U.S. PATENT DOCUMENTS

| | | | |
|---|---|---|---|
| 2,296,980 | A | 9/1942 | Carmichael |
| 2,308,683 | A | 1/1943 | Forbes |
| 2,322,624 | A | 6/1943 | Forbes |
| 3,608,034 | A | 9/1971 | Bramley et al. |
| 3,633,936 | A | 1/1972 | Huber |
| 3,656,790 | A | 4/1972 | Truesdell |
| 3,656,791 | A | 4/1972 | Truesdell |
| 3,733,243 | A | 5/1973 | Crawford |
| 3,893,368 | A | 7/1975 | Wales, Jr. |
| 3,950,584 | A | 4/1976 | Bramley |
| 3,992,628 | A | 11/1976 | Karney |
| 4,051,763 | A | 10/1977 | Thomanek |
| 4,157,411 | A | 6/1979 | Thomson |
| 4,253,132 | A | 2/1981 | Cover |
| 4,262,595 | A | 4/1981 | Longerich |
| 4,358,984 | A | 11/1982 | Winblad |
| 4,399,430 | A | 8/1983 | Kitchen |
| 4,411,462 | A | 10/1983 | Buehrig et al. |
| 4,688,024 | A | 8/1987 | Gadde |
| 4,768,417 | A | 9/1988 | Wright |
| 4,912,869 | A | 4/1990 | Govett |
| 4,928,575 | A | 5/1990 | Smirlock et al. |
| 4,950,198 | A | 8/1990 | Repko, Jr. |
| 5,007,326 | A | 4/1991 | Gooch, Jr. et al. |
| 5,025,707 | A | 6/1991 | Gonzalez |
| 5,069,109 | A | 12/1991 | Lavan, Jr. |
| 5,078,117 | A | 1/1992 | Cover |
| 5,094,170 | A | 3/1992 | Raynaud et al. |
| 5,170,690 | A | 12/1992 | Smirlock et al. |
| 5,191,166 | A | 3/1993 | Smirlock et al. |
| 5,279,199 | A | 1/1994 | August |
| 5,291,715 | A | 3/1994 | Basile |
| 5,333,532 | A | 8/1994 | Smirlock et al. |
| 5,342,021 | A | 8/1994 | Watson |
| 5,370,035 | A | 12/1994 | Madden, Jr. |
| 5,394,786 | A | 3/1995 | Gettle et al. |
| 5,400,688 | A | 3/1995 | Eninger et al. |
| 5,435,226 | A | 7/1995 | McQuilkin |
| 5,441,239 | A | 8/1995 | Watson |
| 5,524,524 | A | 6/1996 | Richards et al. |
| 5,578,784 | A | 11/1996 | Karr et al. |
| 5,583,311 | A | 12/1996 | Rieger |
| 5,609,528 | A | 3/1997 | Kehoe |
| 5,622,455 | A | 4/1997 | Anderson et al. |
| 5,646,613 | A | 7/1997 | Cho |
| 5,705,058 | A | 1/1998 | Fischer |
| 5,725,265 | A | 3/1998 | Baber |
| 5,739,458 | A | 4/1998 | Girard |
| 5,750,918 | A | 5/1998 | Mangolds et al. |
| 5,792,976 | A | 8/1998 | Genovese |
| 5,898,125 | A | 4/1999 | Mangolds et al. |
| 5,924,723 | A | 7/1999 | Brantman et al. |
| 5,988,036 | A | 11/1999 | Mangolds et al. |
| 6,029,558 | A | 2/2000 | Stevens et al. |
| 6,062,617 | A | 5/2000 | Marks |
| 6,119,574 | A | 9/2000 | Burkey et al. |
| 6,128,999 | A | 10/2000 | Sepp et al. |
| 6,279,449 | B1 | 8/2001 | Ladika et al. |
| 6,282,860 | B1 | 9/2001 | Ramirez |
| 6,311,605 | B1 | 11/2001 | Kellner et al. |
| 6,325,015 | B1 | 12/2001 | Garcia et al. |
| 6,374,565 | B1 | 4/2002 | Warren |
| 6,375,251 | B1 | 4/2002 | Taghaddos |
| 6,394,016 | B2 | 5/2002 | Swartout et al. |
| 6,499,796 | B1 | 12/2002 | Eenhoorn |
| 6,595,102 | B2 | 7/2003 | Stevens et al. |
| 6,626,077 | B1 | 9/2003 | Gilbert |
| 6,672,220 | B2 | 1/2004 | Brooks et al. |
| 6,782,792 | B1 | 8/2004 | Edberg et al. |
| 6,805,035 | B2 | 10/2004 | Edberg et al. |
| 6,854,374 | B1 | 2/2005 | Breazeale |
| 6,901,839 | B2 | 6/2005 | Edberg et al. |
| 6,904,838 | B1 | 6/2005 | Dindl |
| 6,925,771 | B2 | 8/2005 | Lee et al. |
| 6,951,348 | B2 | 10/2005 | Enders |
| 6,957,602 | B1 | 10/2005 | Koenig et al. |
| 7,177,518 | B2 | 2/2007 | Chun |
| 7,190,304 | B1 | 3/2007 | Carlson |
| 7,244,199 | B1 | 7/2007 | Romano |
| 7,308,738 | B2 | 12/2007 | Barvosa-Carter et al. |
| 7,328,644 | B2 | 2/2008 | Vickroy |
| 7,412,916 | B2 | 8/2008 | Lloyd |
| 7,415,917 | B2 | 8/2008 | Lloyd |
| 7,513,186 | B2 | 4/2009 | Ravid et al. |
| 7,866,248 | B2 | 1/2011 | Moore, III et al. |
| 7,866,250 | B2 | 1/2011 | Farinella et al. |
| 2001/0032577 | A1 | 10/2001 | Swartout et al. |
| 2001/0048102 | A1 | 12/2001 | Tellis |
| 2002/0134365 | A1 | 9/2002 | Gray |
| 2003/0217502 | A1 | 11/2003 | Hansen |
| 2004/0016846 | A1 | 1/2004 | Blackwell-Thompson et al. |
| 2005/0011396 | A1 | 1/2005 | Burdette et al. |
| 2005/0016372 | A1 | 1/2005 | Kilvert |
| 2005/0278098 | A1 | 12/2005 | Breed |
| 2006/0065111 | A1 | 3/2006 | Henry |
| 2006/0112817 | A1 | 6/2006 | Lloyd |
| 2007/0057495 | A1 | 3/2007 | Tesch et al. |
| 2007/0089597 | A1 | 4/2007 | Ma |
| 2007/0180983 | A1 | 8/2007 | Farinella et al. |
| 2008/0164379 | A1 | 7/2008 | Wartmann et al. |
| 2008/0258063 | A1 | 10/2008 | Rapanotti |
| 2009/0084284 | A1 | 4/2009 | Martinez et al. |
| 2009/0104422 | A1 | 4/2009 | Sampson |
| 2009/0173250 | A1 | 7/2009 | Marscher et al. |
| 2009/0178597 | A1 | 7/2009 | Sliwa, Jr. |
| 2009/0217811 | A1 | 9/2009 | Leeming |
| 2009/0266226 | A1 | 10/2009 | Beach et al. |
| 2009/0266227 | A1 | 10/2009 | Farinella et al. |
| 2009/0308238 | A1 | 12/2009 | Schwartz |
| 2010/0282935 | A1 | 11/2010 | Zannoni |
| 2010/0288114 | A1 | 11/2010 | Soukos |
| 2010/0294124 | A1 | 11/2010 | Wentzel |
| 2010/0307328 | A1 | 12/2010 | Hoadley et al. |
| 2011/0067561 | A1 | 3/2011 | Joynt |
| 2011/0079135 | A1 | 4/2011 | Farinella et al. |
| 2011/0136087 | A1 | 6/2011 | Corridon |
| 2011/0179944 | A1 | 7/2011 | Farinella et al. |
| 2011/0185614 | A1 | 8/2011 | Laney et al. |
| 2011/0203453 | A1 | 8/2011 | Farinella et al. |
| 2012/0011993 | A1 | 1/2012 | Malone et al. |
| 2012/0046916 | A1 | 2/2012 | Farinella et al. |
| 2012/0067199 | A1 | 3/2012 | Farinella et al. |
| 2012/0180639 | A1 | 7/2012 | Farinella et al. |

FOREIGN PATENT DOCUMENTS

| | | |
|---|---|---|
| DE | 3722420 | 1/1989 |
| DE | 3735426 | 5/1989 |
| DE | 3834367 | 4/1990 |
| DE | 4437412 | 9/1995 |
| EP | 0655603 | 5/1995 |
| EP | 0872705 | 10/1998 |
| EP | 0902250 | 3/1999 |
| FR | 2695467 | 3/1994 |
| GB | 2449055 | 11/2008 |
| WO | WO 99/30966 | 6/1999 |
| WO | WO 2006/134407 | 12/2006 |
| WO | WO 2006/135432 | 12/2006 |
| WO | WO 2008/079001 | 7/2008 |
| WO | WO 2008/070001 | 12/2008 |

OTHER PUBLICATIONS

Written Opinion of the International Searching Authority mailed, dated Dec. 23, 2011 for International Application No. PCT/US2011/01462, 6 pages, unnumbered.

File History of U.S. Patent Publication No. 2008/0164379 (through Mar. 1, 2011), 304 pages, unnumbered.

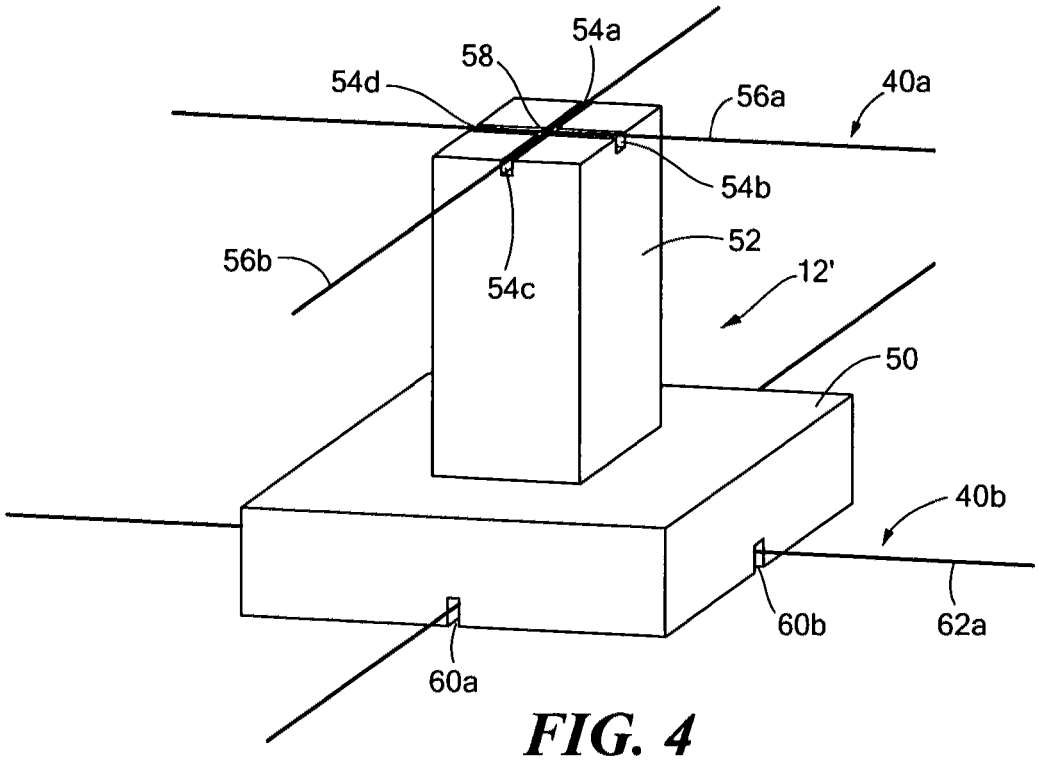
FIG. 4
FIG. 5
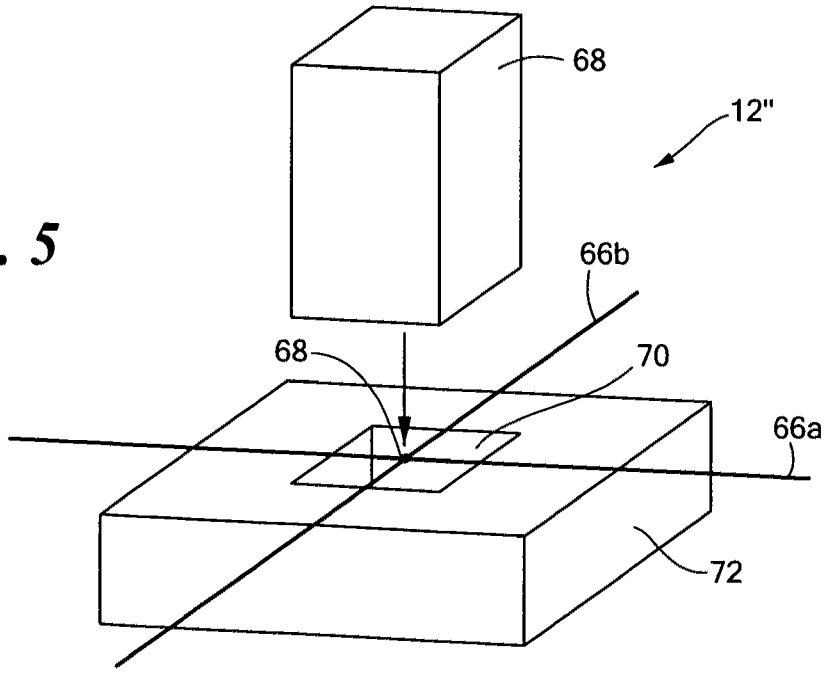

METHOD OF DESIGNING AN RPG SHIELD

RELATED APPLICATIONS

This application is a continuation-in-part of U.S. patent application Ser. No. 12/807,532 filed Sep. 8, 2010 and hereby claims the benefit of and priority thereto under 35 U.S.C. §§119, 120, 363, 365, and 37 C.F.R. §1.55 and §1.78, which application is a continuation-in-part of U.S. patent application Ser. No. 12/386,114 filed Apr. 14, 2009 now U.S. Pat. No. 8,011,285, which claims the benefit of and priority to U.S. Provisional Application Ser. No. 61/124,428 filed Apr. 16, 2008.

FIELD OF THE INVENTION

The subject invention relates to ordinance shielding.

BACKGROUND OF THE INVENTION

Rocket propelled grenades (RPGs) and other ordinance are used by terrorist groups to target military vehicles and structures. See WO 2006/134407 incorporated herein by this reference.

Others skilled in the art have designed intercept vehicles which deploy a net or a structure in the path of an RPG in an attempt to change its trajectory. See U.S. Pat. Nos. 7,190,304; 6,957,602; 5,578,784; and 7,328,644 all incorporated herein by this reference. Related prior art discloses the idea of deploying an airbag (U.S. Pat. No. 6,029,558) or a barrier (U.S. Pat. No. 6,279,499) in the trajectory path of a munition to deflect it. These references are also included herein by this reference.

Many such systems require detection of the RPG and deployment of the intercept vehicle quickly and correctly into the trajectory path of the RPG.

Static armor such as shown in U.S. Pat. Nos. 5,170,690; 5,191,166; 5,333,532; 4,928,575; and WO 2006/134,407 is often heavy and time consuming to install. When a significant amount of weight is added to a HMMWV, for example, it can become difficult to maneuver and top heavy. Such an armor equipped vehicle also burns an excessive amount of fuel.

Moreover, known static systems do not prevent detonation of the RPG. One exception is the steel grille armor of WO 2006/134,407 which is said to destroy and interrupt the electrical energy produced by the piezoelectric crystal in the firing head of the RPG. Bar/slat armor is also designed to dud an RPG. But, bar/slat armor is also very heavy. Often, a vehicle designed to be carried by a specific class of aircraft cannot be carried when outfitted with bar/slat armor. Also, if the bar/slat armor is hit with a strike, the RPG still detonates. Bar/slat armor, if damaged, can block doors, windows, and access hatches of a vehicle.

Chain link fence type shields have also been added to vehicles. The chain link fencing, however, is not sufficiently compliant to prevent detonation of an RPG if it strikes the fencing material. Chain like fencing, although lighter than bar/slat armor, is still fairly heavy. Neither bar/slat armor nor the chain link fence type shield is easy to install and remove.

Despite the technology described in the above prior art, Rocket Propelled Grenades (RPGs) and other threats used by enemy forces and insurgents remain a serious threat to troops on the battlefield, on city streets, and on country roads. RPG weapons are relatively inexpensive and widely available throughout the world. There are varieties of RPG warhead types, but the most prolific are the PG-7 and PG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPGs pose a persistent deadly threat to moving ground vehicles and stationary structures such as security check points.

Heavily armored, lightly armored, and unarmored vehicles have been proven vulnerable to the RPG shaped charge. Pick-up trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The PG-7 and PG-7M are the most prolific class of warheads, accounting for a reported 90% of the engagements. RPG-18s, RPG-69s, and RPG-7Gs have been reported as well, accounting for a significant remainder of the threat encounters. Close engagements 30 meters away occur in less than 0.25 seconds and an impact speed ranging from 120-180 m/s. Engagements at 100 meters will reach a target in approximately 1.0 second and at impact speeds approaching 300 m/s.

The RPG-7 is in general use in Africa, Asia, and the Middle East and weapon caches are found in random locations making them available to the inexperienced insurgent. Today, the RPG threat in Iraq is present at every turn and caches have been found under bridges, in pickup trucks, buried by the road sides, and even in churches.

Armor plating on a vehicle does not always protect the occupants in the case of an RPG impact and no known countermeasure has proven effective. Systems designed to intercept and destroy an incoming threat are ineffective and/or expensive, complex, and unreliable.

Chain link fencing has been used in an attempt to dud RPGs by destroying the RPG nose cone. See, for example, DE 691,067. See also published U.S. Patent Application No. 2008/0164379. Others have proposed using netting to strangulate the RPG nose cone. See published U.S. Application No. 2009/0217811 and WO 2006/135432.

WO 2006/134407, insofar as it can be understood, discloses a protective grid with tooth shaped members. U.S. Pat. No. 6,311,605 discloses disruptive bodies secured to armor. The disruptive bodies are designed to penetrate into an interior region of a shaped charge to disrupt the formation of the jet. The shaped charge disclosed has a fuse/detonator mechanism in its tail end.

BRIEF SUMMARY OF THE INVENTION

No known prior art, however, discloses a net supporting a spaced array of hard points at a set off distance from a vehicle or a structure wherein the hard points are designed to dig into the nose cone of an RPG and dud it.

Pending U.S. patent application Ser. No. 11/351,130 filed Feb. 8, 2006, incorporated herein by this reference, discloses a novel vehicle protection system. The following reflects an enhancement to such a system.

In accordance with one aspect of the subject invention, a new vehicle and structure shield is provided which, in one specific version, is inexpensive, lightweight, easy to install and remove (even in the field), easy to adapt to a variety of platforms, effective, and exhibits a low vehicle signature. Various other embodiments are within the scope of the subject invention.

The subject invention results from the realization, in part, that a new vehicle and structure shield, in one specific example, features a plurality of spaced rods or hard points held in position via the nodes of a net and used to dud an RPG or other threat allowing the frame for the net to be lightweight and inexpensive and also easily attached to and removed from a vehicle or structure.

Featured is a method of designing a shield, including the step of creating a computerized model of a shield mesh opening defined by intersecting lines of a net defining nodes with hard points positioned at least at select nodes. The effectiveness of the mesh opening at a plurality of obliquity angles is determined. The size of the mesh opening is then changed and the effectiveness of this mesh opening at a plurality of obliquity angles is determined. A mesh opening size is chosen based on the determinations.

In one example, the computerized model includes a plurality of different effectiveness zones. For example, a first zone proximate the nodes and a second size centrally located in the mesh opening. A third zone can be between the second and first zones. This second zone can be a function of a critical cone diameter of an RPG before which, if a hard point engages the RPG cone, the effectiveness is high and after which, if a hard point engages the RPG, the effectiveness is lower. In the model, the effectiveness zones change shape as a function of the obliquity angle.

The invention also features a method of designing an RPG shield comprising creating a computerized model of an RPG shield mesh including intersecting lines of a net defining nodes with a hard point positioned at least at select nodes, using the model to determine the effectiveness of a plurality of mesh sizes for a plurality of RPG obliquity angles, and choosing a mesh size based on the determination. The method may further include determining the critical cone diameter for an RPG and using the critical cone diameter in the model to determine the effectiveness of a plurality of mesh sizes for a plurality of horizontal and vertical obliquity angles. For each mesh size, there can be different percentages of the mesh area which would result in an RPG detonation, a high likelihood of defeat of an RPG, and a lower likelihood of defeat of an RPG. Preferably, the mesh size is optimized for different obliquity angles. The method may further include fabricating a net with hard points as modeled and having a mesh size as chosen. In one example, the model revealed mesh size between 110 and 1130 mm was optimal.

Also featured is a method for choosing a mesh size for an RPG shield, the method comprising determining, for an RPG nose cone, a critical cone diameter before which, if impacted, the RPG is defeated by a predetermined percentage and after which, if impacted, the RPG is not defeated by said predetermined percentage. An initial mesh size based at least in part on the critical cone diameter is determined in laboratory experiments. For the chosen net mesh size, at several vertical and horizontal obliquity angles, an estimate is made regarding a percentage of the mesh area which would result in an RPG detonation, a high likelihood of defeat of an RPG, and a lower likelihood of defeat of an RPG. At least one additional net mesh size is chosen and the estimating step is performed again for that mesh size to optimize the mesh size for different obliquity angles. Determining the critical cone diameter may include firing an RPG or surrogate RPG at a net with spaced hard points and evaluating whether the RPG was defeated depending upon where on the nose cone a hard point impacted the RPG.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which:

FIG. 4 is a schematic three-dimensional front view showing one example of a hard point rod attached to adjacent nodes of two spaced nets in accordance with the subject invention;

FIG. 5 is a schematic three-dimensional exploded view showing another example of a hard point rod in accordance with the subject invention;

DETAILED DESCRIPTION OF THE INVENTION

Figure 1:
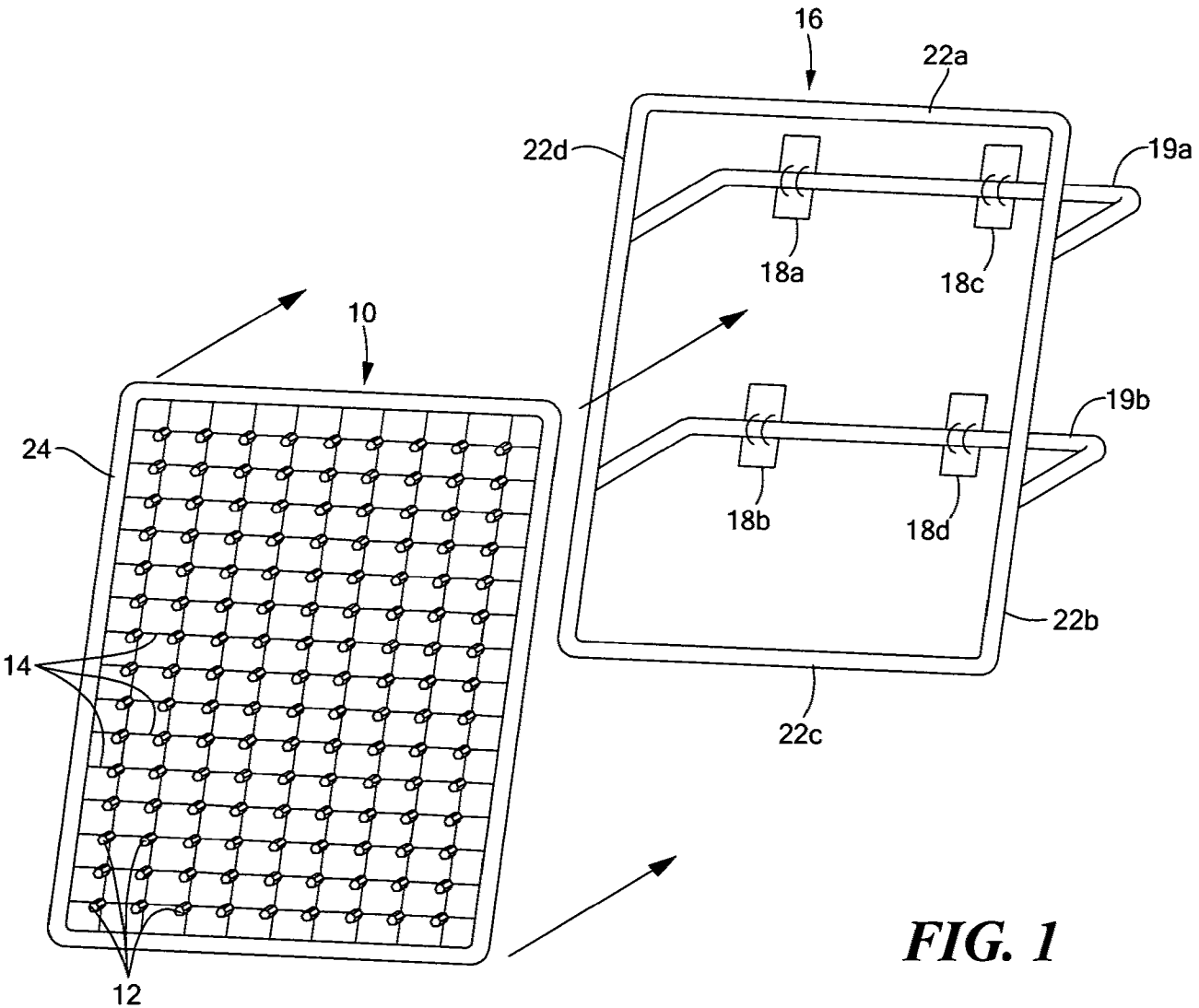
FIG. 1 is a highly schematic three-dimensional exploded view showing an example of one shield protection system in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of flexible structures, e.g., net subsystem 10 and including an array of rods 12 configured to impact a projectile (e.g., the nose of an RPG) striking net 14. Frame 16 includes mounting brackets 18*a*-18*d* attached to rearwardly extending members 19*a* and 19*b*. The function of frame 16 and net 14 is to position rods 12 in a spaced relationship with respect to a vehicle or structure and to space the rods 12 apart from each other in an array. When an RPG impacts net 14, rods 12 may angle inwardly towards the nose of the RPG tearing into it and duding the electronics and/or electrical or electronic signals associated with the arming or detonation mechanisms of the RPG. By flexible, we generally mean a net which does not retain its shape unless supported in some fashion. When not attached to frame 16, net 14 can be rolled and then folded and/or net 14 can be bunched up.

Figure 2:
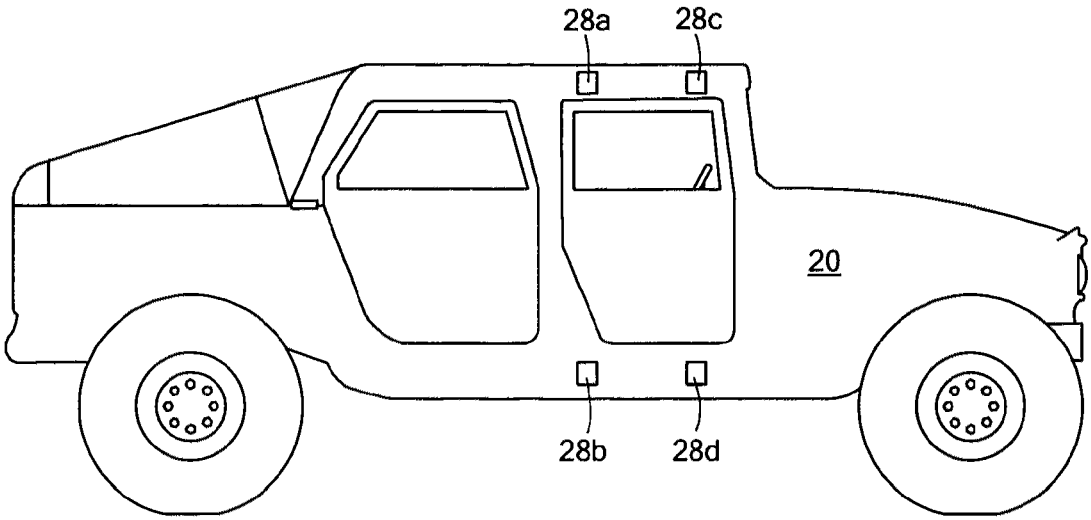
FIG. 2 is a schematic side view of a HMMWV vehicle equipped with hook and loop patches for installation of the shield system shown in FIG. 1.

Preferably, net subsystem 10 is removeably secured to frame 16 and frame 16 is removeably secured to vehicle 20, FIG. 2 (e.g., a HMMWV vehicle). In one particular example, frame members 22*a*-22*d* include hook type fasteners secured to the outside thereof and the net periphery includes loop type fasteners on the inside thereof. Loop type fasteners are also secured to the rear of frame 16 mounting brackets 18*a*-18*d* and corresponding pads or patches 28*a*-28*d*, FIG. 2, adhered to vehicle 20, include outer faces with hook type fasteners. The hook and loop fastening mechanisms, however, maybe reversed and other flexible fastener subsystems may also be used. The hook and loop fastening subsystems of U.S. Pat. Nos. 4,928,575; 5,170,690; 5,191,166; and 5,333,532 are preferred.

Figure 3:
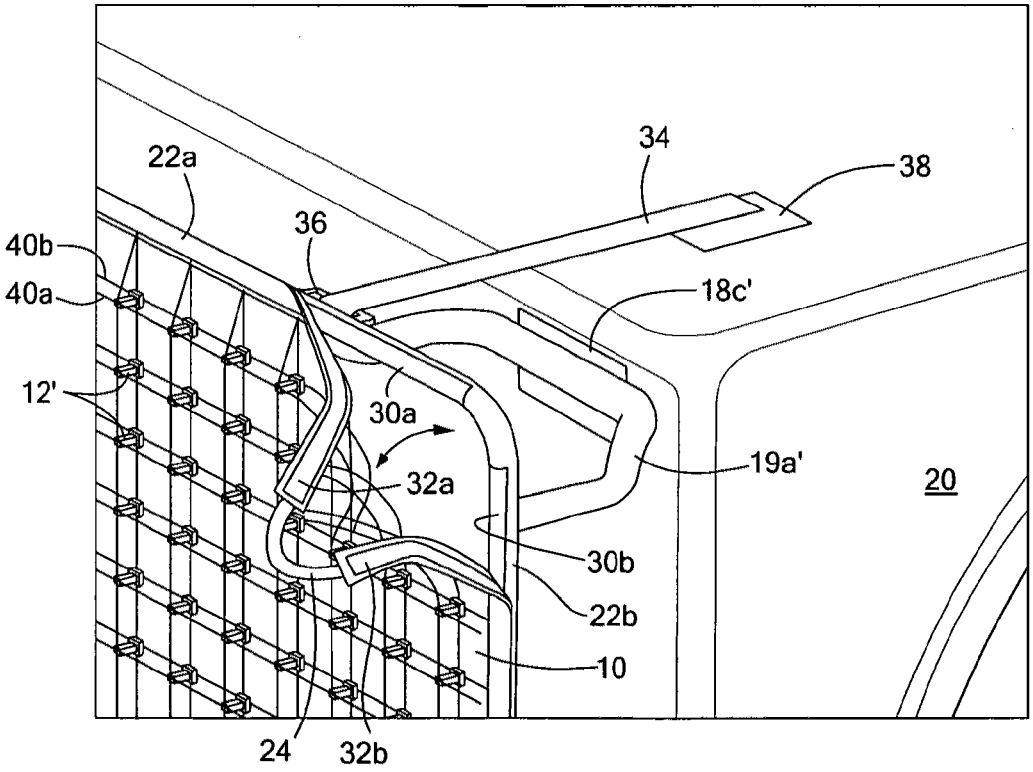
FIG. 3 is a schematic partial side view showing a shield subsystem in accordance with an example of the subject invention now installed on a portion of a vehicle.

FIG. 3 shows frame members 22*a* and 22*b* including hook type fastener strips 30*a* and 30*b*, respectively, and net periphery fabric border 24 including loop type fastener strips 32*a* and 32*b*. Mounting bracket 18*c*' is attached to rearwardly extending frame member 19*a*' and includes a rearward face with loop type fasteners. FIG. 3 also shows optional strap 34 extending from ear 36 on frame member 22*a* to attachment 38 on vehicle 20 which may also be secured to vehicle 20 using hook and loop fasteners. Additional straps may also be included. FIG. 3 also shows first (outer) net 40*a* and second (inner) net 40*b* with their nodes interconnected via rods 12'.

As shown in FIG. 4, rod 12' includes base portion 50 and post portion 52 extending from base portion 50. Post 52 includes castellations 54*a*-54*d* for the cord lines 56*a* and 56*b* of net 40*a* defining node 58. Similarly, base 50 includes castellations (e.g, castellations 60*a* and 60*b*) for lines 62*a* and 62*b* of net 40*b* also defining a node (not shown). The lines of the nets may be glued or otherwise secured in the castellations.

FIG. 5 shows a single net design where net lines 66*a* and 66*b* defining node 68 are secured between post portions 68 frictionally received in cavity 70 of base portion 72 of rod 12". The preferred rod is made of steel, has a one inch post, and weighs between 15 and 30 grams.

Figure 6A:
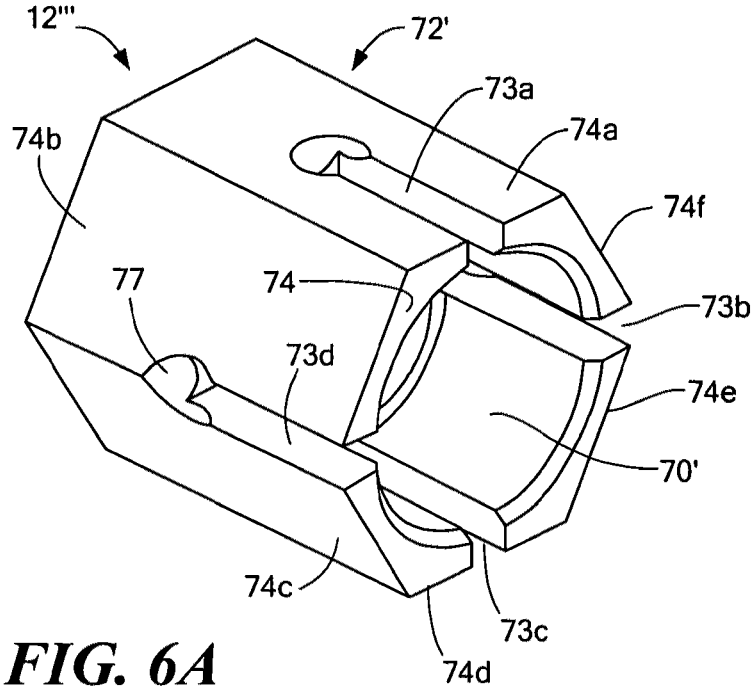
FIGS. 6A-6D are schematic views of other hard point designs in accordance with examples of the subject invention.
Figure 6B:
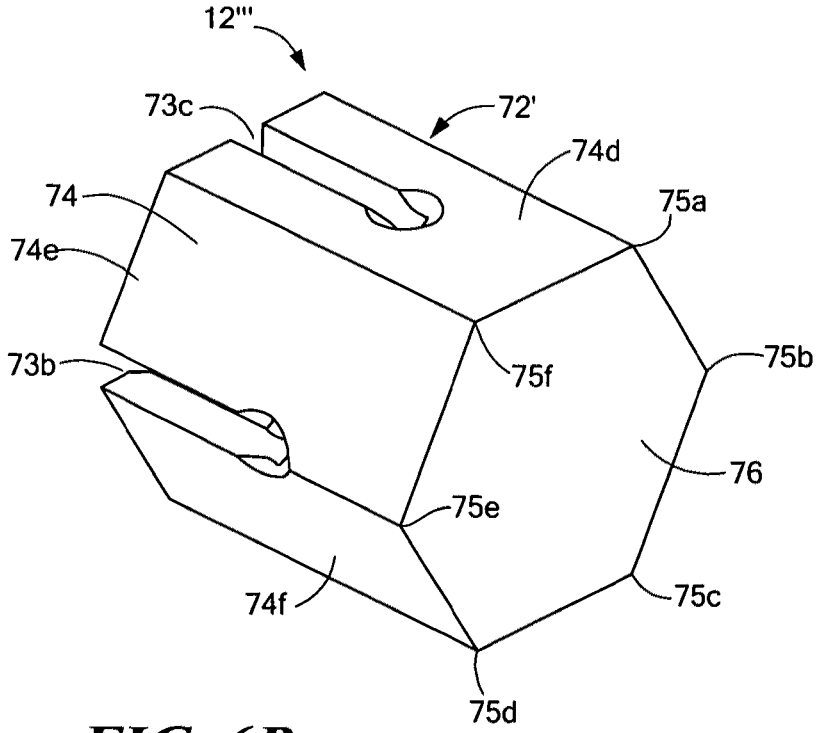
Figure 7A:
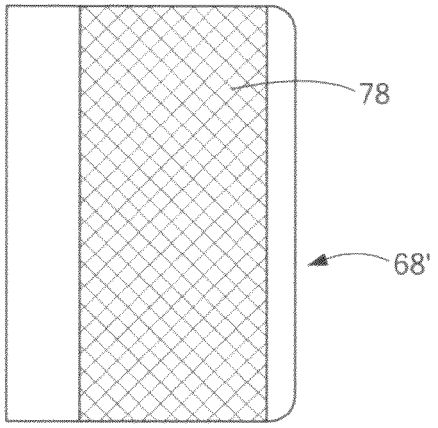
FIG. 7A-7B are schematic views of a plug for the hard point shown in FIGS. 6A-6D.
Figure 7B:
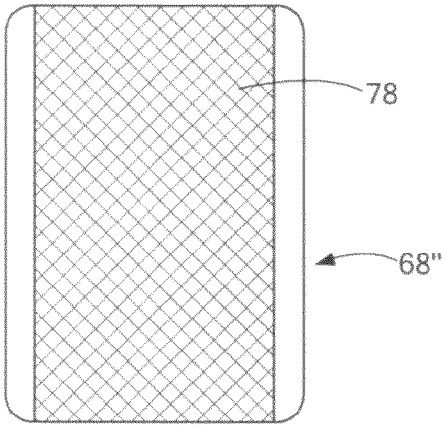

FIGS. 6A-6B shows hard point 12'" with forward facing base portion 72' with cavity 70' receiving post or plug 68', FIG. 7 therein in a friction fit manner. This hard point is designed for nets including horizontal cords intersecting vertical cords. See FIGS. 1 and 5. In this preferred design, the net cords are received through slots 73*a*-*d* in wall 74 of hard point 72'. The slots, as shown for slot 73*a*, terminate in rounded portion 77 preventing wear of the net cords. Wall 74 in this embodiment defines a six-sided structure with six sharp corners 75*a*-75*f* which dig into the skin of an RPG ogive. Top surface 76 may be flat as shown or concave. Slots 73*a* and 73*c* receive vertically extending cord 66*b*, FIG. 5 while slots 73*d* and 73*b*, FIG. 6A receive horizontally extending cord 66*a*, FIG. 5. In one specific design, the hard point and the plug were made of steel, hard point 72' was 0.625 inches from one edge to an opposite edge, and 0.72 inches tall. Cavity 70' was 0.499 inches in diameter and 0.34 inches deep. Five gram cylindrical plug 68', FIGS. 7A-7B was 0.35 inches tall, 0.500 inches in diameter, and includes knurling as shown at 78 on the outer wall surface thereof.

Side walls 74*a*-74*f* extend rearward from front face 76 defining cavity 70' surrounded by the side walls. Opposing sidewalls 74*a* and 74*d* have slots (73*a*, 73*c*) in the middle of each side wall. Slots 73*d*, and 73*b*, in turn, are between adjacent sidewalls 74*b* and 74*c* and 74*f* and 74*e*, respectively. Sidewall 74*b* and 74*c* are between opposing sidewalls 74*a* and 74*b* on one side of member 72' while sidewall 74*f* and 74*e* are between opposing sidewalls 74*a* and 74*d* on the opposite side of member 72'.

In this specific design, the base portion 72' and plug 68' (FIG. 7) were made of hardened steel (e.g., ASTM A108 alloy 12L14) and combined weighed between 10 and 80 grams. A base portion with more or less sides is also possible. For a six sided design, the area of face 76, FIG. 6B, is typically about 0.5 in.$^2$, e.g. between 0.1 and 0.8 in.$^2$. Sidewalls 74*a*-*f* typically have an area of 0.37 in.$^2$, e.g., between 0.1 and 0.8 in.$^2$. Slots 73*a*-*d* may be 0.05-0.15 inches wide and between 0.2 and 0.8 inches long.

Figure 6C:
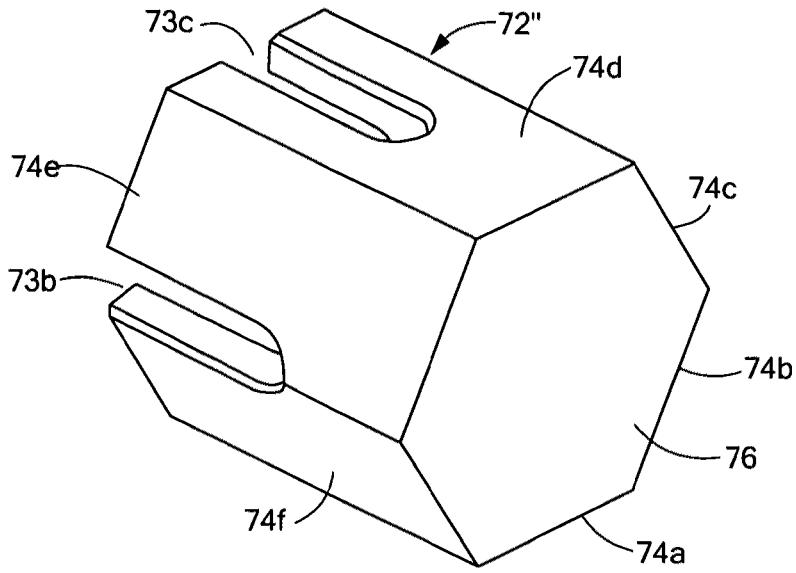
Figure 6D:
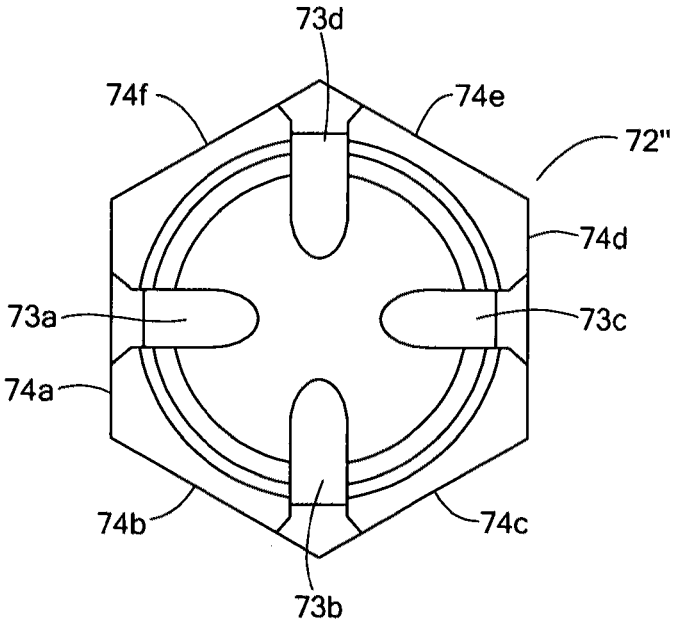

Manufacturing of a net with hard points in accordance with the subject invention is thus simplified. A net node is placed in cavity 70', FIG. 6A with the net lines exciting through slots 73*a*-73*d* and plug 68', FIG. 7A is then driven in to cavity 70', FIG. 6A to lock the node of the net in the hard point. The hard points are typically made of conductive material and may include a protective rust resistant non-reflective, conductive coating (zinc plating, flat olive in color). In one example shown in FIGS. 6C-6D, base portion 72" weighed 30 grams and was machined from 0.625 hex bar stock. Walls 74*a*-74*f* were 0.72" tall. Slots 73*a*-73*d* were 0.080 inches across and 0.350" in length. These dimensions will vary, however, depending on the design of the net.

There are trade offs in the design of the hard points and also the net. The aspect ratio of the hard points, their size, center of gravity, mass, and the like all play an important role. Hard points which are too large, for example, and a net mesh size which is too small, results in too much surface area to be stricken by an RPG, possibly detonating the RPG. Hard points which are too small may not sufficiently damage the RPG ogive and dud the RPG. Steel is a good material choice for the hard points because steel is less expensive. Tungsten, on the other hand, may be used because it is heavier and denser, but tungsten is more expensive. Other materials are possible. The hard points may be 0.5 inch to 0.75 inches across and between 0.5 inches and 1 inch tall.

It is preferred that the net node is placed at the center of gravity at the hard point. The length of the hard point is preferably chosen so that when an RPG strikes the net, the hard point tumbles 90 degrees and digs into the RPG ogive. The moment of inertia of the hard point is designed accordingly. In still other designs, the hard point may have more or less than six sides. The hard points may weigh between 10 to 80 grams although in testing 60 grams was found to be optimal, e.g., a 30 gram base portion and a 30 gram plug. Hard points between 10 and 40 grams are typical.

The net material may be polyester which provides resistance to stretching, ultraviolet radiation resistance, and durability in the field. Kevlar or other engineered materials can be used. A knotted, knotless, braided, or ultracross net may be used. The line diameter may be 1.7 to 1.9 mm. Larger net lines or multiple lines are possible, however, the line(s) design should be constrained to beneath threshold force to dynamic break loads typical of RPG impact and engagements. The typical net mesh size may be 176 mm (e.g., a square opening 88 mm by 88 mm) for a PG-7V RPG and 122 mm for a PG-7 VM model RPG. But, depending on the design, the net mesh size may range from between 110 and 190 mm.

The preferred spacing or standoff from the net to the vehicle is between 4 and 24 inches, (e.g., 6-12 inches) but may be between 4 and 60 centimeters. Larger standoffs may extend the footprint of the vehicle and thus be undesirable. Too close a spacing may not insure closing of the electrical circuitry of the RPG ogive by the hard points. The frame and mounting brackets are designed to result in the desired spacing.

It is desirable that the net material and mesh size be chosen and the net designed such that an RPG ogive, upon striking a net line, does not detonate. RPGs are designed to detonate at a certain impact force. Preferably, the breaking strength of the net line material is around 240 lbs so that an RPG, upon striking a net line or lines, does not detonate. The net is thus designed to be compliant enough so that it does not cause detonation of the RPG. Instead, the hard points dig into the RPG ogive and dud the RPG before it strikes the vehicle or structure.

This design is in sharp contrast to a much more rigid chain link fence style shield which causes detonation of the RPG if the RPG strikes a wire of the fence. The overall result of the subject invention is a design with more available surface area where duding occurs as opposed to detonation.

Figure 8:
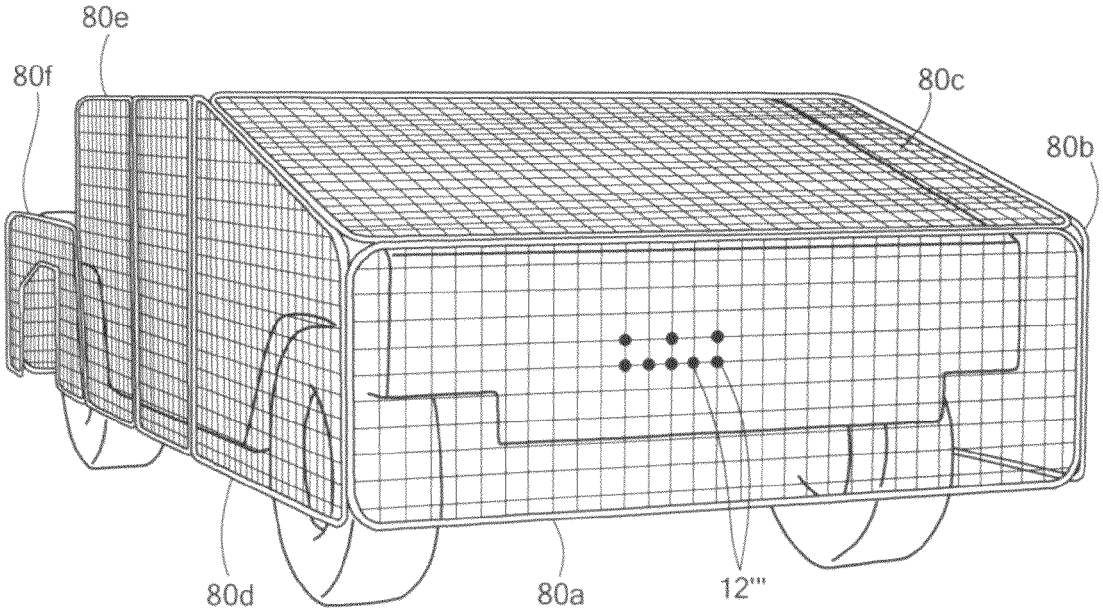
FIG. 8 is a schematic three-dimensional front view showing a number of net shields removeably attached to a military vehicle in accordance with the subject invention.
Figure 9:
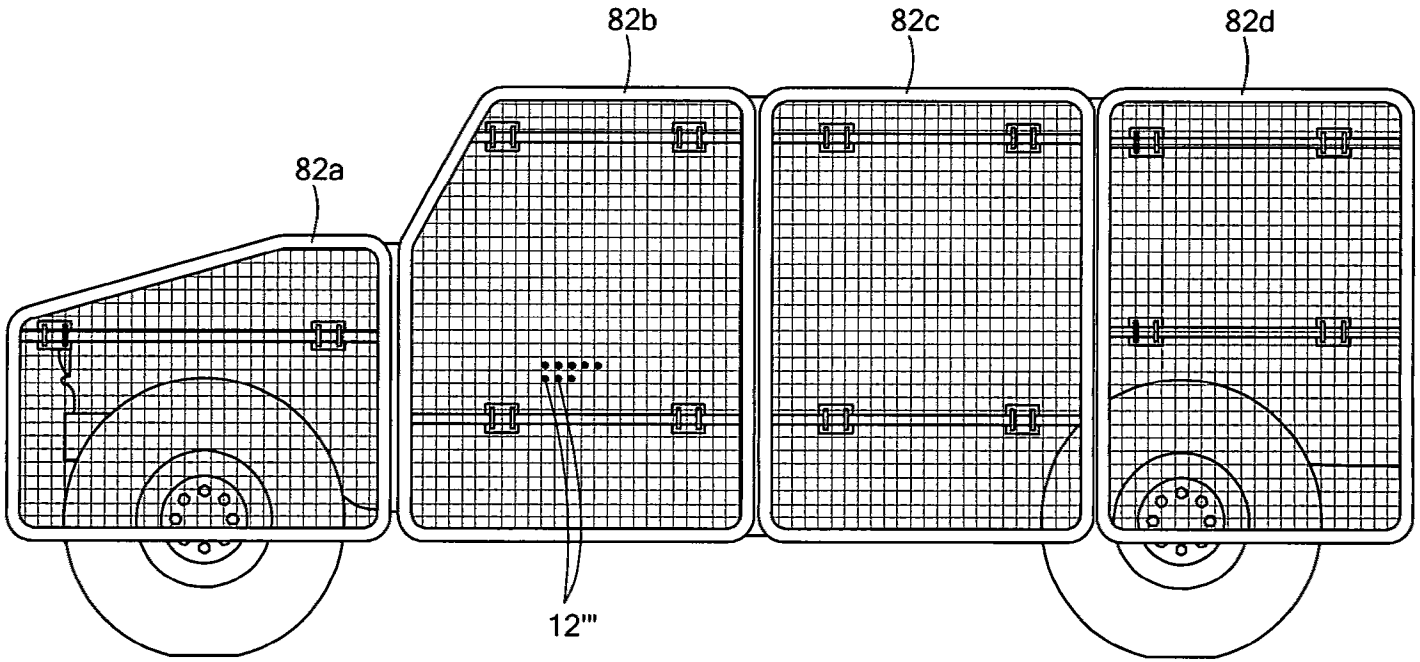
FIG. 9 is a schematic three-dimensional side view showing a number of net shields attached to the side of a military vehicle.
Figure 11:
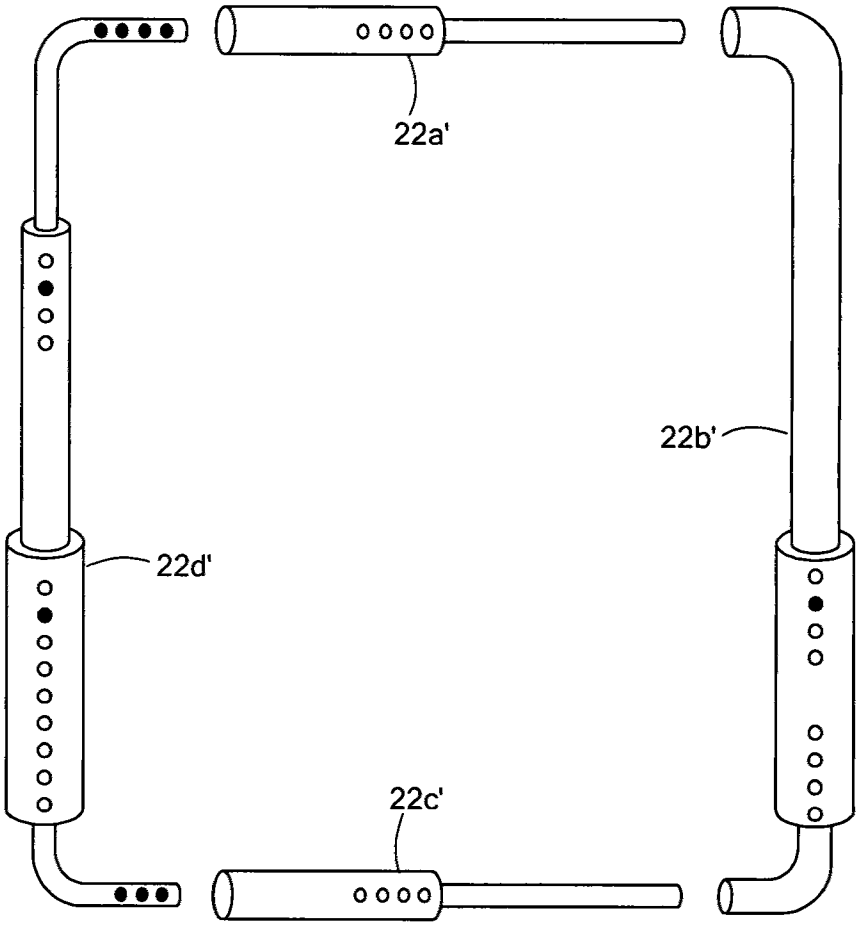
FIG. 11 is a schematic three-dimensional exploded front view showing telescoping frame members in accordance with the subject invention.

FIG. 8 shows shields 80*a*-80*f* and the like in accordance with the subject invention protecting all of the exposed surfaces of vehicle 20. FIG. 9 shows shields 82*a*-82*d* in accordance with the subject invention protecting the driver's side of vehicle 20. Only a few hard points 12''' are shown for clarity. Typically, there is a hard point at each node of the net.

Figure 10:
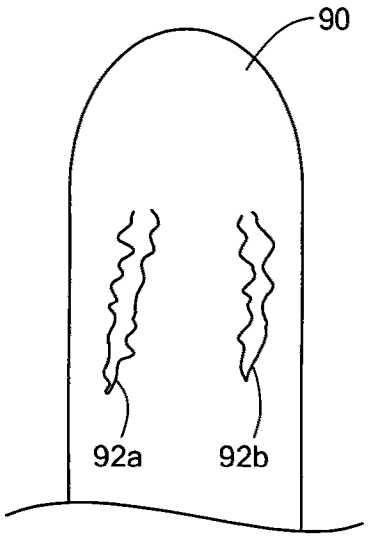
FIG. 10 is a highly schematic three-dimensional top view showing a RPG nose duded by the shield subsystem in accordance with the subject invention.

When an RPG nose or ogive 90, FIG. 10 strikes a shield, the rods or hard points at the nodes of the net(s) angle inwardly toward nose 90 and tear into the skin thereof as shown at 92*a* and 92*b*. The hard points can bridge the inner and outer ogive serving as short to dud the RPG. Or, the hard points tear into the ogive and the torn material acts as a short duding the round. If the net and/or frame is destroyed, another shield is easily installed. The net thus serves to position the hard points in an array at a set off distance from the vehicle or structure to be protected. An effectiveness of 60-70% is possible. Chain link fencing exhibited an effectiveness of about 50%. Netting without hard points likely exhibited an effectiveness of less than 50%. Slat/bar armor reportedly had and effectiveness of around 50%.

FIG. 9 shows how frame members 22*a*' can comprise adjustable length telescoping sections for ease of assembly and for tailoring a particular frame to the vehicle or structured portion to be protected.

In one embodiment, the frame members are made of light weight aluminum. One complete shield with the net attached weighed 1.8 lbs. The shield is thus lightweight and easy to assemble, attach, and remove. If a given shield is damaged, it can be easily replaced in the field. The rods connected to the net cell nodes are configured to angle inwardly when an RPG strikes the net. This action defeats the RPG by duding it since the electronics associated with the explosives of the RPG are shorted as the rods impact or tear through the outer skin of the RPG ogive.

The result, in one preferred embodiment is an inexpensive and light weight shielding system which is easy to install and remove. The shields can be adapted to a variety of platforms and provide an effective way to prevent the occupants of the vehicle or the structure from injury or death resulting from RPGs or other ordinances. When used in connection with vehicles, the shield of the subject invention exhibits a low vehicle signature since it extends only a few inches from the vehicle.

The system of the subject invention is expected to meet or exceed the effectiveness of bar/slat armor and yet the flexible net style shield of the subject invention is much lighter, lower in cost, and easier to install and remove. The system of the subject invention is also expected to meet or exceed the effectiveness of chain link fence style shields and yet the net/hard point design of the subject invention is lower in cost, lighter and easier to install and remove.

Figure 12A:
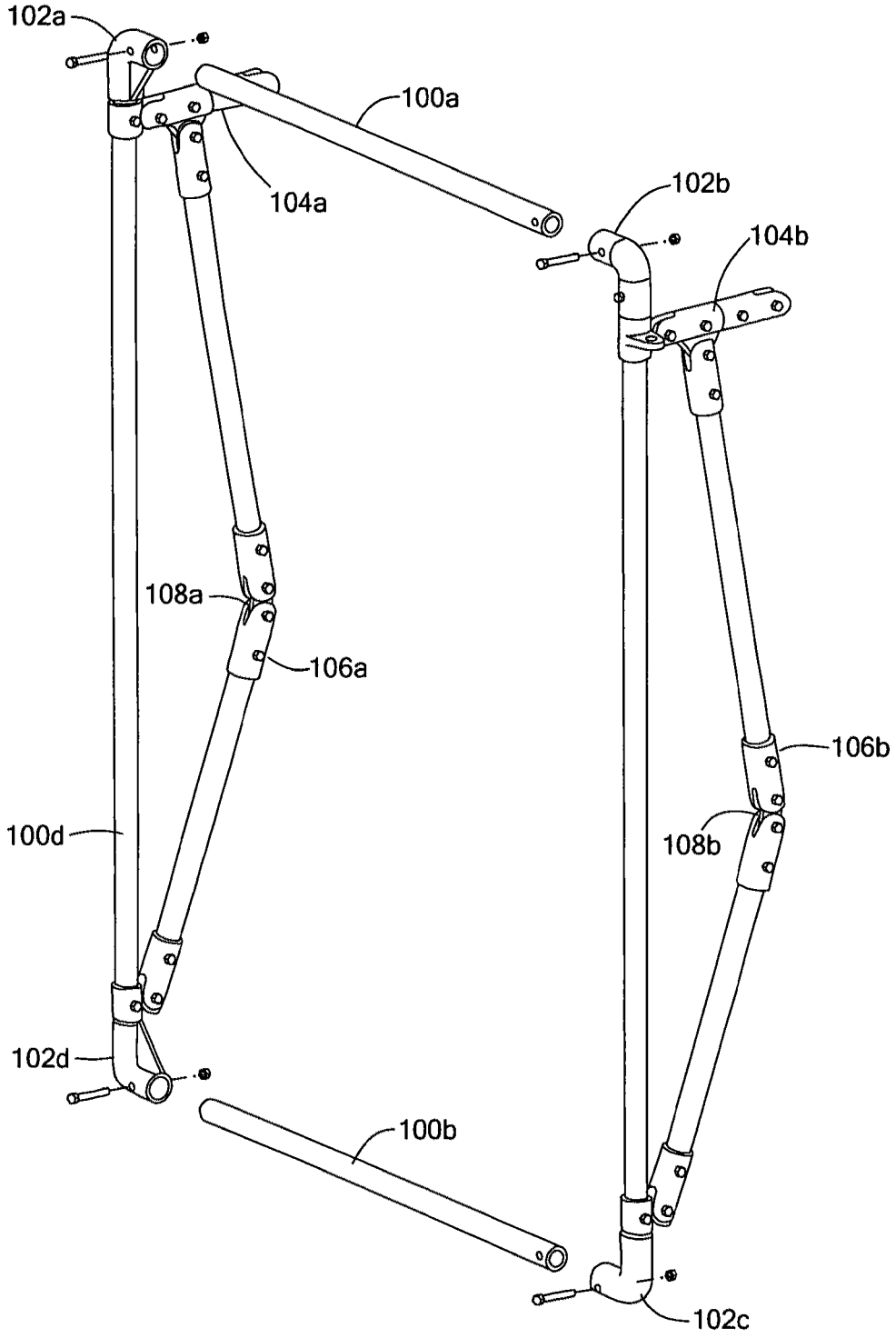
FIG. 12A is a front view of a frame structure in accordance with an example of the invention.
Figure 12B:
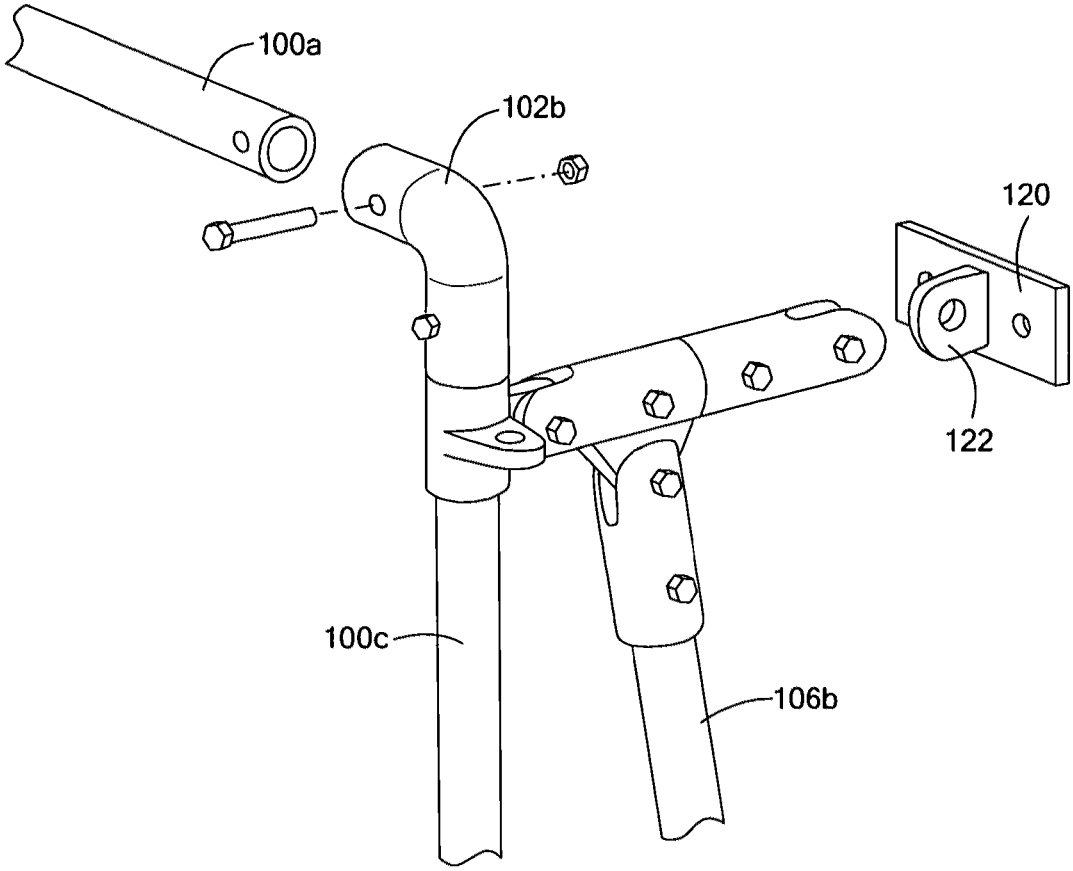
FIG. 12B is a view of one portion of the frame structure shown in FIG. 12A.

One design of a frame 16, FIGS. 12A-12B includes tubular upper frame member 100*a*, lower frame member 100*b*, and side frame members 100*c* and 100*d* all interconnected via corner members 102*a*-*d*. The result is a polygon with spaced sides and an upper and lower portion.

Figure 12C:
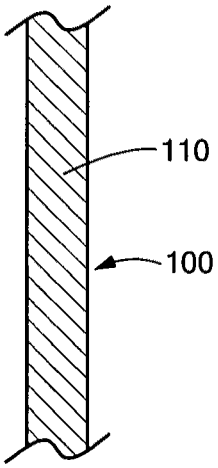
FIG. 12C is a front view of one frame member of the frame structure shown in FIG. 12A showing a spiral wrap of Velcro material thereabout.

Spaced rearwardly extending members 104*a* and 104*b* are attached to the upper portion of the members 100*d* and 100*c*, respectively, just below the corner members 102*a* and 102*b*. Rearwardly extending members 106*a* and 106*b* are on each side of the frame and each include a hinged joint 108*a* and 108*b*, respectively. Each of these members extends between a side member at the bottom of the frame and a rearwardly extending member at the top of the frame where they are hingely attached thereto. All of the hinged joints may be pin and clevis type joints as shown. As shown in FIG. 12C, each frame member 100*a*-100*d* includes a spiral wrap 110 of a hook type fastener material secured thereto to releasably receive the loop type fastener material (32*a*, 32*b*, FIG. 3) of the net fabric border. In this way, the net is easily attached and removed from the frame.

Typically, the frame is attached to the vehicle or structure using metal plates with an ear extending outwardly therefrom, such as plate 120, FIG. 12*b* with ear 122.

In other instances, however, features already associated with the vehicle or structure to be protected can be used to secured the frame with respect to the vehicle or structure.

Figure 13:
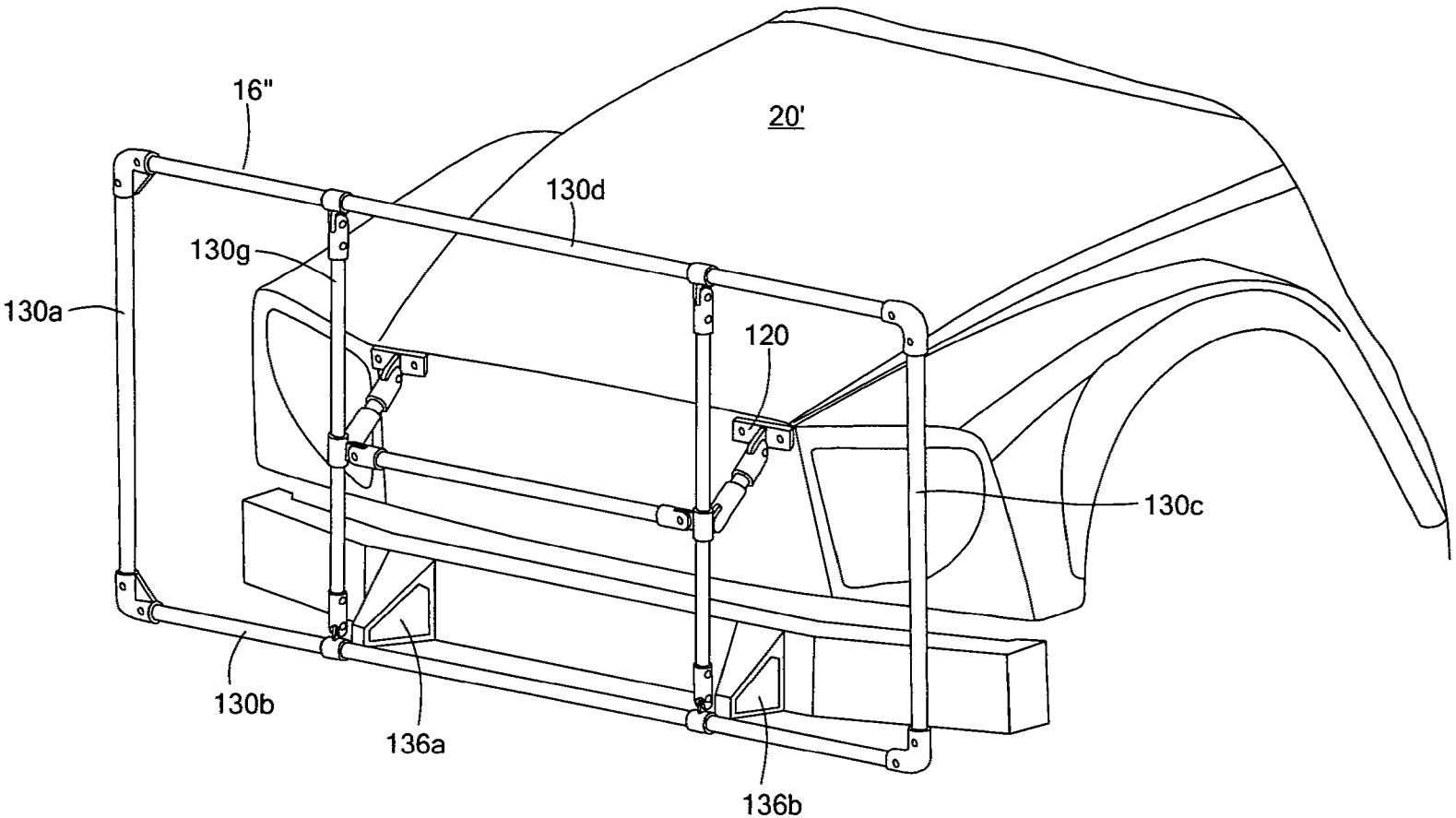
FIG. 13 is a partial schematic view showing a frame structure attached to the front of a vehicle in accordance with an example of the subject invention.

For example, FIG. 13 shows frame 16" attached to a vehicle. Frame 16" includes frame members 130*a*-130*g*, rearwardly extending member 132*a* and 132*b* hingely connected to plates 134*a* and 134*b*, respectively, bolted to the vehicle. Features 136*a* and 136*b* of vehicle 20' are connected to the joints between frame members 130*b*, 130*g* and 130*f*. Thus, the frame, the mounting brackets, and the like may vary in construction depending on the configuration of the vehicle or structure to be protected, the location on the vehicle to protected and the like. Typically, the frame members are tubular aluminum components and in one example they were 1-2 inches outer diameter, 0.75-1.75 inches inner diameter, and between 3 and 10 feet long.

Figure 14:
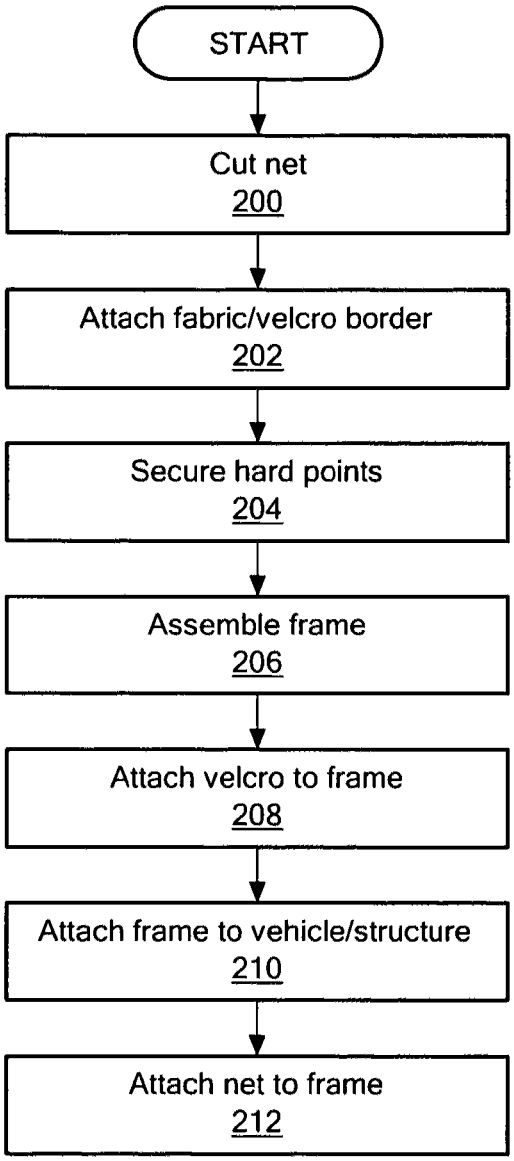
FIG. 14 is a flow chart depicting the primary steps associated with a method of protecting a vehicle or structure in one example of the invention.

Assembly of a vehicle or structure shield, in accordance with the invention, typically begins with cutting the bulk netting, step 200, FIG. 14 into square or rectangular shapes. Next a fabric border is sewed to the net edges, step 202 and includes loop type fastener material on at least one side thereof.

The hard points are they secured to the net nodes, step 204. For example, the net may be laid on a table and hard point female members 72', FIG. 6A-6B are positioned under each node with the net cords extending through slot 73*a*-73*d*. Plugs 68', FIG. 7, are then driven partly into each cavity of the female base portions using finger pressure and/or a hammer. Then, the plugs are seated in their respective cavities using a pneumatic driver.

The appropriate frame is then designed and assembled step 206, FIG. 14, and the hook fastener material is taped or glued to the frame members (see FIG. 12C), step 208. In the field, the frame is secured to the vehicle or structure, step 210, and the net is attached to the frame, step 212, using the loop type fastener material of the net periphery border and the hook fastener material on the frame members.

Assembly of the frame to the vehicle or structure and releasably attaching the net to the frame is thus simple and can be accomplished quickly.

Figure 15:
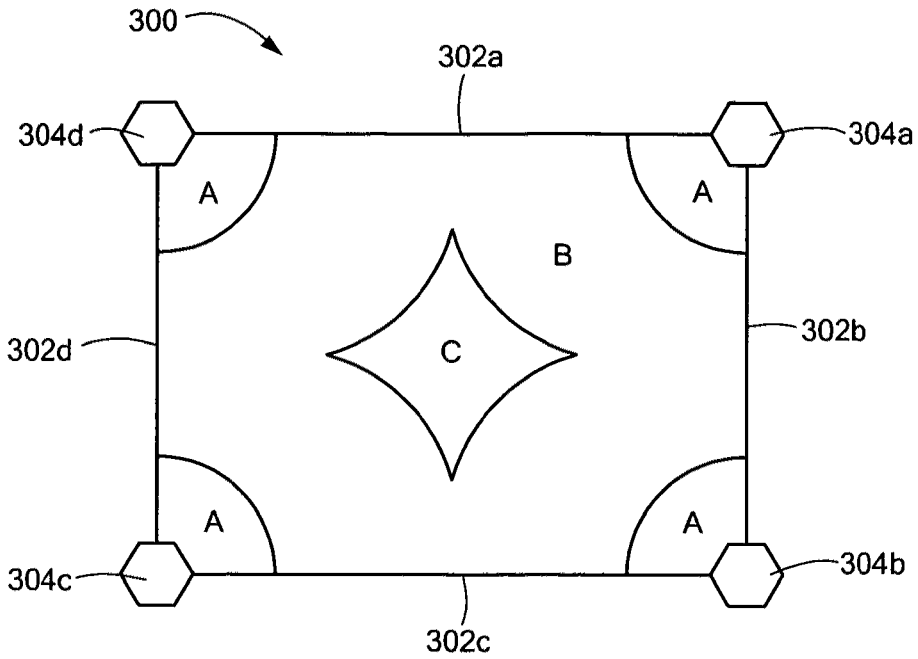
FIG. 15 is a schematic depiction of a computerized model of a net mesh opening in accordance with an example of the invention.

FIG. 15 depicts a computerized model of a net mesh opening 300 defined by intersecting net strands or cords 302*a*-302*d* creating nodes where hard points 304*a*-304*d* are located (see also FIG. 1). The effectiveness of the mesh opening is also modeled as shown via zones A, B, and C which may be depicted on the model in different colors or with labels or the like.

Figure 16:
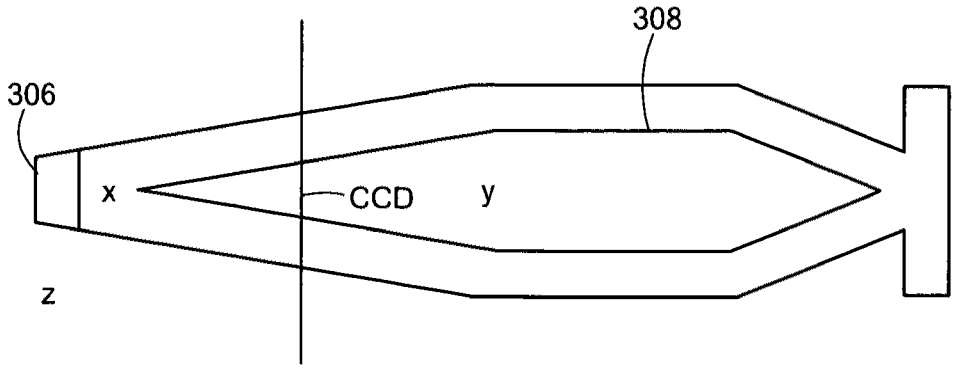
FIG. 16 is a view showing the location of the critical cone diameter for an example of an RPG as determined in testing using an example of the method of the invention.

At zone A proximate the hard points located at the nodes, there is a fairly high likelihood the fuse (306) FIG. 16 at the end of RPG 308 may strike a hard point resulting detonation of the RPG and a resulting low effectiveness of the shield. In the zone B, the shield is highly effective (e.g., 80% effective) since one or more hard points 304*a*-304*d* begin tearing into the RPG ogive skin near the tip of the RPG. A hard point has more of a chance of duding the electronic circuitry under the ogive skin to defeat thus the RPG. Zone C is less effective (e.g., only 40% effective) since one or more hard points 304*a*-304*d* might not begin to tear into the RPG ogive skin until further along the length of the RPG nose cone and might not cause tears of sufficient length or size needed to interrupt or destroy electrical or electronic circuitry under the ogive skin.

During testing, it was realized there is a critical cone diameter (CCD) for each model RPG. As shown in FIG. 16, for a specific RPG (in this example, the RPG 7M), the CCD was determined to be at the location shown in the figure (e.g., at a location where the RPG nose was approximately 45 millimeters in diameter). Between the tip of the RPG at fuse 306 and the CCD location, one or more hard points tearing into the ogive skin have a high likelihood (e.g., 80%) of damaging the electrical or electronic fusing circuitry under the RPG skin since the resulting tears are longer and larger. For example, a tear beginning at point X in FIG. 16 before the location of the CCD might extend all the way up to and beyond the CCD location.

But, a hard point which first engages in the nose cone beyond the location of the CCD, for example, at location Y, might not result in a long or large enough tear and might not disrupt the RPG fusing circuitry.

Figure 18:
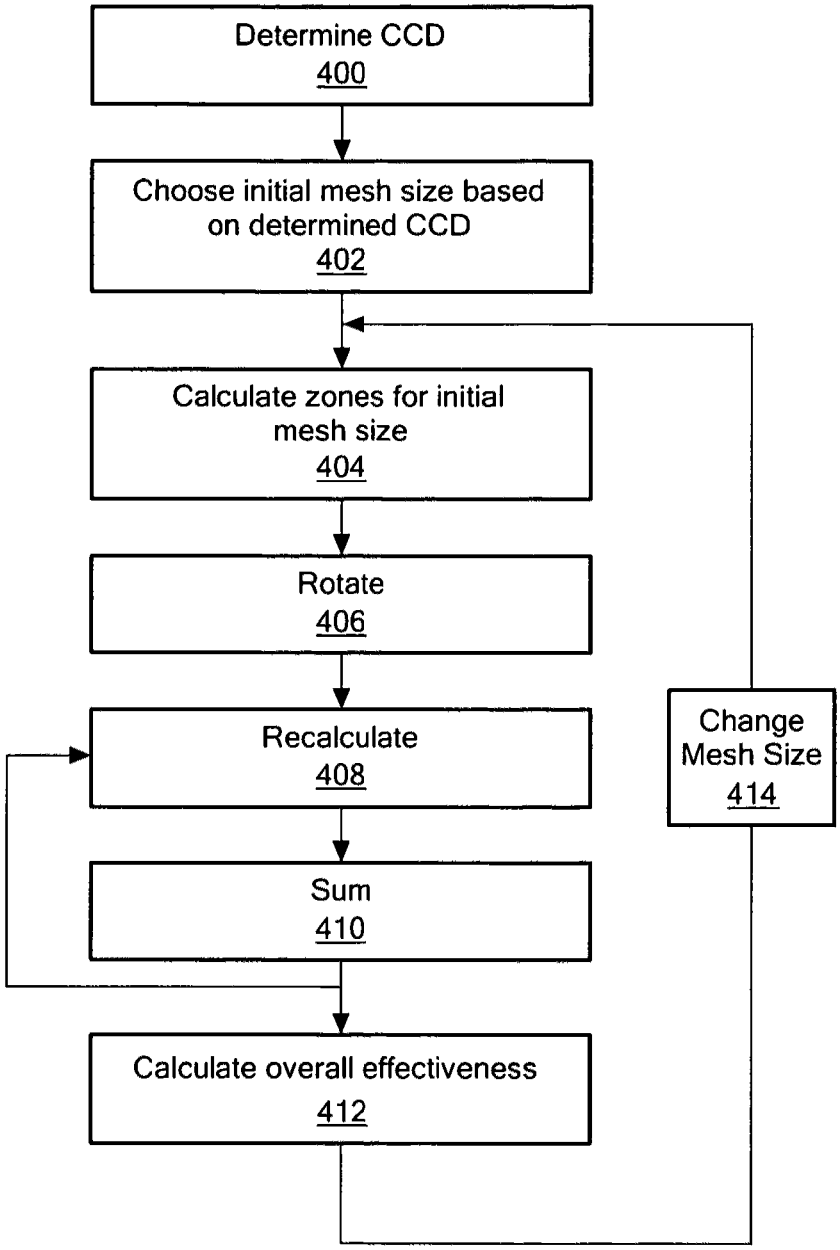
FIG. 18 is a flow chart of several of the primary steps associated with an example of a method in accordance with the invention.

The location of the CCD can be determined by firing a surrogate RPG at a net with spaced hard points and evaluating whether the RPG was defeated depending upon where, on the nose cone, a hard point impacted the RPG. The effectiveness was determined for several hard point impacts at different locations along the length of the RPG nose cone. As noted above, at locations between the tip of the RPG and the location marked CCD in FIG. 16, it was determined there was an effectiveness of 80% or greater that the RPG would be defeated. At locations beyond the location of CCD, impacts of one or more hard points resulted in an effectiveness of less than 80%. Live firings may also be used in testing to determine the location of the CCD for a given model RPG. See step 400, FIG. 18.

This data was used, in part, to define more centrally located (and less effective) zone C in FIG. 15 and to choose an effective net mesh opening size. Typically, the goal is to minimize zones A and C while maximizing zone B. This can be accomplished by choosing, amongst a variety of net mesh sizes, the most optimal net mesh sizes and also choosing the configuration and/or size of the hard points.

Note that if an RPG strikes a net cord, for example, cord 302*c*, FIG. 15, the cord is designed to break rather than trigger RPG fuse 306, FIG. 16.

It was also discovered using the model shown in FIG. 15 that a net mesh size optimized in this manner for RPG strikes normal to the plane of mesh opening 300 may result in non-optimal effectiveness for RPG strikes at different angles with respect to the plane of the mesh opening.

Figure 17:
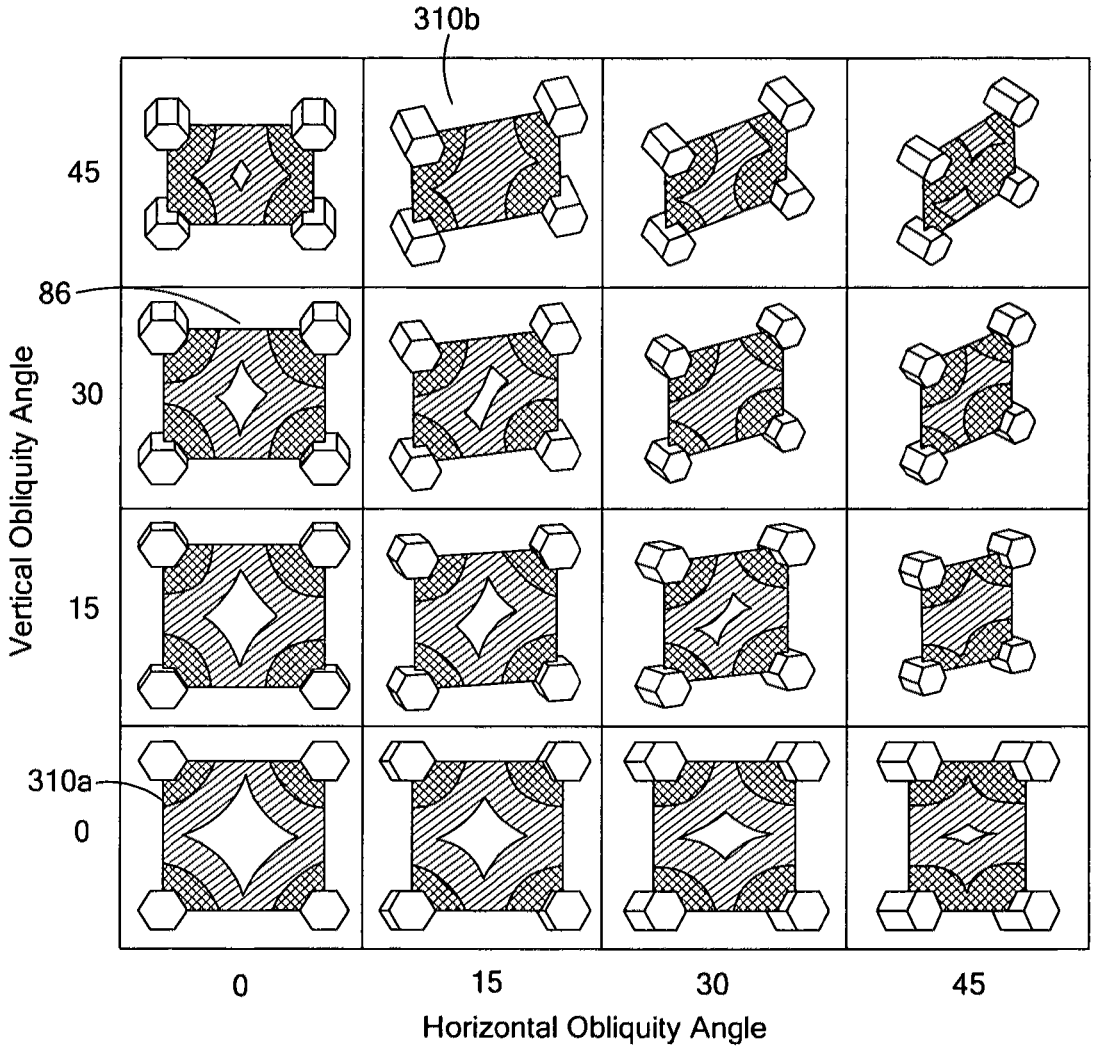
FIG. 17 is a depiction of a computerized model of a net mesh opening for a number of horizontal and vertical obliquity angles in accordance with an example of the invention.

Thus, in this invention, the effectiveness of the net mesh size is evaluated for different PRG obliquity angles as shown in FIG. 17. An overall RPG defeat effectiveness can be established for each of the plurality of obliquity angles. Suppose, for example, that at a zero horizontal and zero vertical obliquity as shown at 310*a* (see also FIG. 15), an effectiveness of 70% or so is set based on the relative sizes and/or areas of zones A, B, and C, FIG. 15. At a vertical obliquity angle of 45° and a horizontal obliquity angle of 30°, as shown at 310*b* an effectiveness of 60% or so is set based on the relative sizes or areas of zones A, B, and C. Here, zone C is nearly zero, desirable zone B has increased, but so too has undesirable zone A. In this way, effectiveness for each obliquity angle can be established and total effectiveness calculated. Suppose for a mesh size of 120 mm for an RPG with a 45 mm CCD, the total average effectiveness across all obliquity angles is 6. This initial mesh size can be determined based, at least in part, on the CCD, step 402, FIG. 18. In step 404, the zones shown in FIG. 17 are calculated and displayed for different obliquity angles, steps 406-408. The effectiveness for each angle is then summed, steps 410 and 412 to determine the overall effectiveness. Now, using the computerized model, the net mesh size can be changed to between, say, 110 mm and 130 mm, and the effectiveness modeled again. See step 414. Using this modeling technique, it was determined that a 122 mm mesh side was optimal for specific threat simulations.

As such, a given mesh size, which is highly effective at a zero horizontal, zero vertical obliquity angles may not be as optimal across all obliquity angles when compared to a different net size which has a lower effectiveness at zero horizontal, zero vertical obliquity angles but which has a higher overall effectiveness across other obliquity angles.

The effectiveness of different sizes and shapes of hard points may also be determined in this manner where, in addition, the net mesh size may be varied and modeled as discussed above.

In general, then, net mesh opening sizes are chosen based on the determination of the effectiveness of the net mesh size opening at different obliquity angles. The critical cone diameter of a particular RPG may be set and also used in the model. The net is then fabricated as discussed above once the optimal net mesh size is chosen. Shields for other ordinances may be modeled in the same or a similar manner.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A method of designing a shield, the method comprising:

creating a computerized model of a shield mesh opening defined by intersecting lines of a net defining nodes with hard points positioned at least at select nodes;

determining the effectiveness of the mesh opening at a plurality of obliquity angles;

in the model, changing the size of the mesh opening and determining the effectiveness of said mesh opening at a plurality of obliquity angles; and choosing a mesh opening size based on said determinations.

2. The method of claim 1 in which the computerized model includes a plurality of different effectiveness zones.

3. The method of claim 2 in which a first said zone is proximate the nodes and a second said zone is centrally located in the mesh opening.

4. The method of claim 3 in which a third said zone is between the second and first zones.

5. The method of claim 3 in which the second said zone is a function of a critical cone diameter of an RPG before which, if a hard point engages the RPG cone, the effectiveness is high and after which, if a hard point engages the RPG, the effectiveness is lower.

6. The method of claim 2 in which the effectiveness zones change shape as a function of the obliquity angle.

7. The method of claim 1 in which choosing a mesh size includes optimizing the mesh size for different obliquity angles.

8. A method of designing an RPG shield, the method comprising:

creating a computerized model of an RPG shield mesh including intersecting lines of a net creating nodes with a hard point positioned at least at select nodes;

using the model to determine the effectiveness of a plurality of mesh sizes for a plurality of RPG obliquity angles; and choosing a mesh size based on said determination.

9. The method of claim 8 further including the step of determining a critical cone diameter for an RPG and using the critical cone diameter in the model to determine the effectiveness of said plurality of mesh sizes for a plurality of obliquity angles.

10. The method of claim 8 in which determining includes, for each mesh size, establishing percentages of the mesh area which would result in an RPG detonation, a high likelihood of defeat of an RPG, and a lower likelihood of defeat of an RPG.

11. The method of claim 8 in which the obliquity angles include a number of horizontal obliquity angles and a number of vertical obliquity angles.

12. The method of claim 8 further including fabricating a net with hard points as modeled and having a mesh size as chosen.

13. The method of claim 8 in which the mesh size chosen is between 110 and 130 mm.

14. The method of claim 9 in which determining the critical cone diameter includes evaluating a location on the RPG wherein, between a tip of the RPG and said location, an impact by a hard point results in a predetermined effectiveness and, at locations beyond said location, an impact by a hard point results in an effectiveness less than said predetermined effectiveness.

15. A method of choosing a mesh size for an RPG shield, the method comprising: determining, for an RPG nose cone, a critical cone diameter wherein, between a tip of the RPG and said critical cone diameter, an impact by a hard point results in a predetermined effectiveness and, at locations beyond said critical cone diameter, an impact by a hard point results in an effectiveness less than said predetermined effectiveness; choosing an initial mesh size based at least in part on the critical cone diameter, determined in laboratory experiments; for the chosen net mesh size, at several vertical and horizontal obliquity angles, estimating a percentage of the mesh area which would result in an RPG detonation, a high likelihood of defeat of an RPG, and a lower likelihood of defeat of an RPG; and choosing at least one additional net mesh size and performing said estimating step for said mesh size to optimize the mesh size for different obliquity angles.

16. The method of claim 15 in which determining the critical cone diameter includes firing an RPG or surrogate RPG at a net with spaced hard points and evaluating whether the RPG was defeated depending upon where on the nose cone a hard point impacted the RPG.

* * * * *